US006342126B1

(12) United States Patent
Grabscheid et al.

(10) Patent No.: US 6,342,126 B1
(45) Date of Patent: Jan. 29, 2002

(54) WIRE SECTION, BELT GUIDANCE DEVICE, AND PROCESS FOR FORMING FIBROUS MATERIAL WEB IN WIRE SECTION

(75) Inventors: Joachim Grabscheid, Gerestetten; Volker Schmidt-Rohr, Heidenheim; Dieter Egelhof, Heidenheim; Johann Moser, Heidenheim; Hans Dahl, Ravensburg; Roger Wiedenmann, Giengen, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/487,831

(22) Filed: Jan. 20, 2000

(30) Foreign Application Priority Data

Jan. 21, 1999 (DE) ..... 199 02 274

(51) Int. Cl.[7] ..... D21F 11/00; D21F 3/10

(52) U.S. Cl. ..... 162/203; 162/301; 162/367; 162/374

(58) Field of Search ..... 162/203, 301, 162/357, 365, 366, 367, 368, 369, 370, 371, 372, 373, 374, 318, 319, 363, 364; 492/20

(56) References Cited

U.S. PATENT DOCUMENTS 5,466,342 A * 11/1995 Kankaanpaa ..... 162/301
5,480,520 A * 1/1996 Esslinger ..... 162/301
5,647,958 A 7/1997 Schmidt-Rohr et al. .... 162/203
6,083,349 A * 7/2000 Schiel ..... 162/206

FOREIGN PATENT DOCUMENTS

DE 4420801 12/1995 ..... D21F/1/00

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

Wire section, guidance device, and process of forming a web in a machine for producing a fibrous material web. The device include two revolving endless wire belts, a twin wire zone formed between the two revolving endless wire belts, and a revolving flexible support belt located in a vicinity of the twin wire zone and positioned to support at least one of the two wire belts in a support region. The flexible support belt is generally guided along an at least essentially circular cylindrical path, and the support region includes a support path having an average curvature radius that is greater than a curvature radius of the essentially circular path. The process includes supporting at least one of the two endless wire belts with the flexible support belt in a support region, rotating the flexible support belt along a generally circular path, and deflecting the support belt from the generally circular path in the support region, whereby the support belt in the support regions travels along a support path. An average radius of curvature of the flexible support belt in the support path is greater than an average radius of curvature of the flexible support belt in the generally circular path.

52 Claims, 2 Drawing Sheets

WIRE SECTION, BELT GUIDANCE DEVICE, AND PROCESS FOR FORMING FIBROUS MATERIAL WEB IN WIRE SECTION

CROSS-REFERENCE TO RELATED APPLICATIONS

The present application claims priority under 35 U.S.C. § 119 of German Patent Application No. 199 02 274.7, filed on Jan. 21, 1999, the disclosure of which is expressly incorporated by reference herein in its entirety.

BACKGROUND OF THE INVENTION

1. Field of the Invention

The present invention relates to a wire section of a machine for producing a fibrous material web, e.g., a paper or cardboard web, having a twin wire zone formed between two revolving endless wire belts, and a revolving flexible support belt located in a vicinity of the twin wire zone that supports at least one of the two wire belts. The revolving flexible support belt is positioned inside the loop of the at least one wire belt. The present invention also relates to a belt guidance device for the wire section, and a process for forming a fibrous material web in the wire section.

2. Discussion of Background Information

In a known twin-wire former, an inside surface of one of the two wire belts is, as a rule, guided over a former cylinder located in the vicinity of an inlet nip of the twin wire zone. In order to provide greater curvature radii, correspondingly dimensioned former cylinders must be used, which considerably increases the demand for space.

A wire section of the type generally discussed above is disclosed, e.g., in DE 44 20 801 A1. In such a wire section, an endless flexible support belt is provided instead of a former cylinder and is guided by three deflection rolls in a generally triangular course.

SUMMARY OF THE INVENTION

The present invention provides a wire section of the type generally discussed above that also provides that the wire belts are guided in the support region along a path with the greatest possible curvature radius, and with a minimal space requirement for wire belt guidance. Furthermore, a suitable belt guidance device and a process for forming the fibrous material web in the wire section is provided.

Accordingly, the instant invention provides a wire section in which the flexible support belt, which is generally guided in or along an at least essentially circular cylindrical path, is guided in the support region along a path which deviates from a circular cylindrical path and which has a greater average curvature radius than a radius of the circular cylindrical path. Further, the average curvature radius is greater than an average curvature radius of the entire path that the support belt passes through.

Based on the exemplary embodiment, greater curvature radii are possible in the support region of interest without having to simultaneously accept a correspondingly greater structural volume. The space requirement for the respective support belt guidance can be practically independent of a respective curvature radius in the support region and can be reduced to a minimum corresponding to the at least essentially circular cylindrical guidance.

The flexible support belt preferably has an open outer circumference surface that is used to store water. Thus, the outer circumference surface can, for example, be profiled and/or provided with blind bores. In particular, it can be grooved, bored, and/or blind bored, and/or can have a knob structure. In the latter case, the knobs can have a circular or square cross section, for example.

In an alternative exemplary embodiment of the wire section according to the invention, the flexible support belt can be guided in the support region by way of internal support elements that are spaced apart from one another in the web travel direction. The wire belt provided on the side of the twin wire zone remote from the support belt can preferably be acted on by internal pressing elements, which can be pressed against it in a flexible manner and can be located opposite from intermediary spaces between the support elements. The two wire belts, together with the fibrous material web formed between them, can then be pressed against the flexible support belt, particularly by the pressing elements.

The pressing elements can be constructed, e.g., of former strips or the like.

In certain cases, it can be advantageous for the pressing elements to be provided in combination with a forming box.

In another exemplary embodiment, the wire belt provided on the side of the twin wire zone remote from the support belt can be internally acted on by suction elements, e.g., slot suction elements, which are disposed opposite the support elements and/or opposite the intermediary spaces remaining between them.

In certain cases, it can be useful for the flexible support belt to be guided in at least one other region along a path that extends inside the circular cylindrical path, with the resulting additional space produced being at least partially taken up by another element of the machine, e.g., the headbox. The other region can be defined, e.g., by two internal support elements disposed spaced apart from one another, between which the flexible support belt travels in a straight line.

In order to guide the flexible support belt on the support elements, an inner region of the support belt loop, which is remote from the support element region and sealed off from it, can be subjected to overpressure. In another embodiment, the flexible support belt is guided around an internal tube and the annular space formed between the internal tube and a support belt is divided by sealing elements into a region that contains the support elements and a region that is subjected to overpressure. The overpressure can be, e.g., approximately 50 to 100 mbar and can be adjusted to, e.g., approximately 60 mbar. Fundamentally, however, other values are also conceivable.

The revolving flexible support belt may be laterally fixed in a suitable manner by covering disks or the like.

Internally, the flexible support belt can be lubricated in particular with fluid, e.g., with water, oil, and/or the like, and the support elements can be correspondingly designed for a lubrication of this kind. In this connection, a hydrodynamic and/or hydrostatic lubrication can be provided.

The belt guidance device according to the present invention includes a plurality of support elements located inside a loop of a flexible support belt, which are arranged so that the flexible support belt is guided in an at least essentially circular cylindrical fashion and, in a support region of at least one wire belt, felt band, and/or the like, is guided along a path that deviates from the circular cylindrical path. The flexible support belt has an average curvature radius (R) that is greater than a radius ($R_K$) of the essentially circular cylindrical path, and that is greater than an average curvature radius of an entire path through which the support belt travels.

Accordingly, the present invention is directed to a wire section of a machine for producing a fibrous material web that includes two revolving endless wire belts, a twin wire zone formed between the two revolving endless wire belts, and a revolving flexible support belt located in a vicinity of the twin wire zone and positioned to support at least one of the two wire belts in a support region. The flexible support belt is generally guided along an at least essentially circular cylindrical path, and the support region includes a support path having an average curvature radius that is greater than a curvature radius of the essentially circular path.

In accordance with a feature of the invention, the average curvature radius of the support path can be greater than an average curvature radius of an entire path through which the support belt travels.

According to another feature of the invention, the flexible support belt may be located within a loop formed by the at least one wire belt.

The flexible support belt can include an open outer circumference surface adapted to store water. The outer circumference surface of the flexible support belt may be one of profiled and blind bored.

Further, internal support elements may be arranged spaced from each other in a web travel direction. The internal support elements can be positioned to guide the flexible support belt in the support region. Moreover, internal pressing elements may be positioned opposite intermediary spaces between the support elements. The internal pressing elements can be arranged to act on the wire belt located on a side of the twin wire zone remote from the flexible support belt by pressing against the wire belt. The internal pressing elements can be arranged to act on both of the two wire belts as well as the fibrous material web being formed between them. As an example, the internal pressing elements may be at least partially composed of former strips and/or a forming box can be provided, in which the internal pressing elements are provided in combination with the forming box. Alternatively, or additionally, suction elements may be positioned opposite at least one of the internal support elements and intermediary spaces between the support elements. The suction elements can be arranged to internally act on the wire belt located on a side of the twin wire zone remote from the flexible support belt.

According to still another feature of the instant invention, the flexible support belt may include at least one additional region that is guided along an additional path that extends inside the circular cylindrical path. The at least one additional region can create an additional space, and the additional space may be at least partially occupied by another element of the machine, e.g., a headbox. Moreover, internal supports may be located spaced from each other. The additional region can be defined by two of the internal support elements, and the additional path can include a straight path between the two internal support elements.

In accordance with a further feature of the present invention, the flexible support belt can include an inner region which is positioned remote from the support region. The inner region may be sealed off from the support region, and the inner region can be subjected to an overpressure. The overpressure can be between approximately 50 and 100 mbar, and the overpressure may be adjusted to approximately 60 mbar.

According to another feature of the invention, an internal tube may be provided. An annular space can be formed between the internal tube and the support belt, and sealing elements may be positioned to divide the annular space into the support region and a region subjected to overpressure. The support region can include a plurality of support elements, and the overpressure can be between approximately 50 and 100 mbar, and adjusted to approximately 60 mbar.

In accordance with another feature of the present invention, covering disks can be provided. The revolving flexible support belt may be laterally fixed by the covering disks.

Further still, the flexible support belt may be internally lubricated. The flexible support belt can be internally lubricated with a fluid, and the flexible support belt can be at least one of hydrodynamically and hydrostatically lubricated. Moreover, support elements may be located within the flexible support belt in the support region, and the support elements can be lubricated in a manner corresponding to the internal lubrication of the flexible support belt.

According to a still further feature of the invention, the fibrous material web can include one of a paper and a cardboard web.

The present invention is also directed to a belt guidance device for an apparatus for producing a fibrous material web. The belt guidance device includes a flexible support belt in the form of a loop, a plurality of support elements located inside the loop of the flexible support belt, which are arranged to generally guide the flexible support belt along an at least essentially circular cylindrical path. The flexible support belt includes a support region adapted to support and guide at least one of a wire belt and felt band along a support path that deviates from the circular cylindrical path and that has an average curvature radius that is greater than a radius of the circular cylindrical path.

The present invention is also directed to a process of forming a fibrous material web in a wire section that includes a twin wire zone formed between two endless wire belts, a revolving flexible support belt located in a vicinity of the twin wire zone. The process includes supporting at least one of the two endless wire belts with the flexible support belt in a support region, rotating the flexible support belt along a generally circular path, and deflecting the support belt from the generally circular path in the support region, whereby the support belt in the support regions travels along a support path. An average radius of curvature of the flexible support belt in the support path is greater than an average radius of curvature of the flexible support belt in the generally circular path.

According to a feature of the instant invention, the average radius of curvature of the flexible support belt in the support path may be greater than an average radius of curvature for an entire travel path of the flexible support belt.

In accordance with another feature of the present invention, the process can further include inserting fibrous material between the two wire belts, and pressing the two wire belts and the fibrous material therebetween against the flexible support belt. The process can further include suctioning the fibrous material through the wire belt positioned remote from the flexible support belt.

According to yet another feature of the instant invention, the process can further include deflecting another portion of the flexible support belt along a path that extends through the generally circular path.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
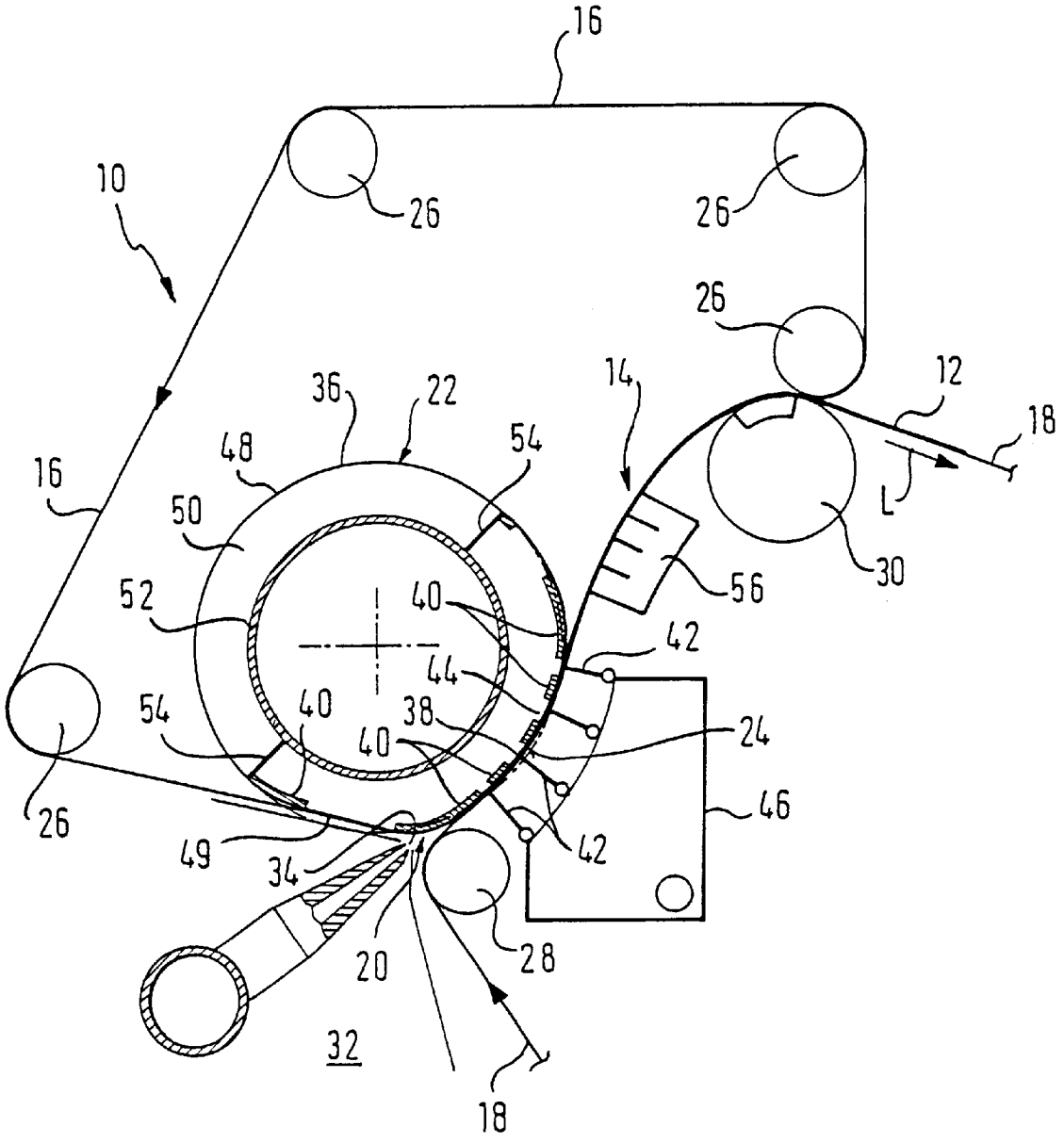
FIG. 1 illustrates a schematic representation of a wire section of a machine for producing a fibrous material web.

FIG. 1 illustrates a wire section 10 for producing a fibrous material web 12 which can be, e.g., a paper or cardboard web. As shown in FIG. 1, wire section 10 includes a twin wire zone 14 which can be formed, e.g., with an endless upper wire belt 16 and an endless lower wire belt 18. In twin wire zone 14, which adjoins an inlet nip 20, wire belts 16 and 18, as well as a fibrous material web 12 to be formed which is located between wire belts 16 and 18, are guided parallel to one another.

Figure 2:
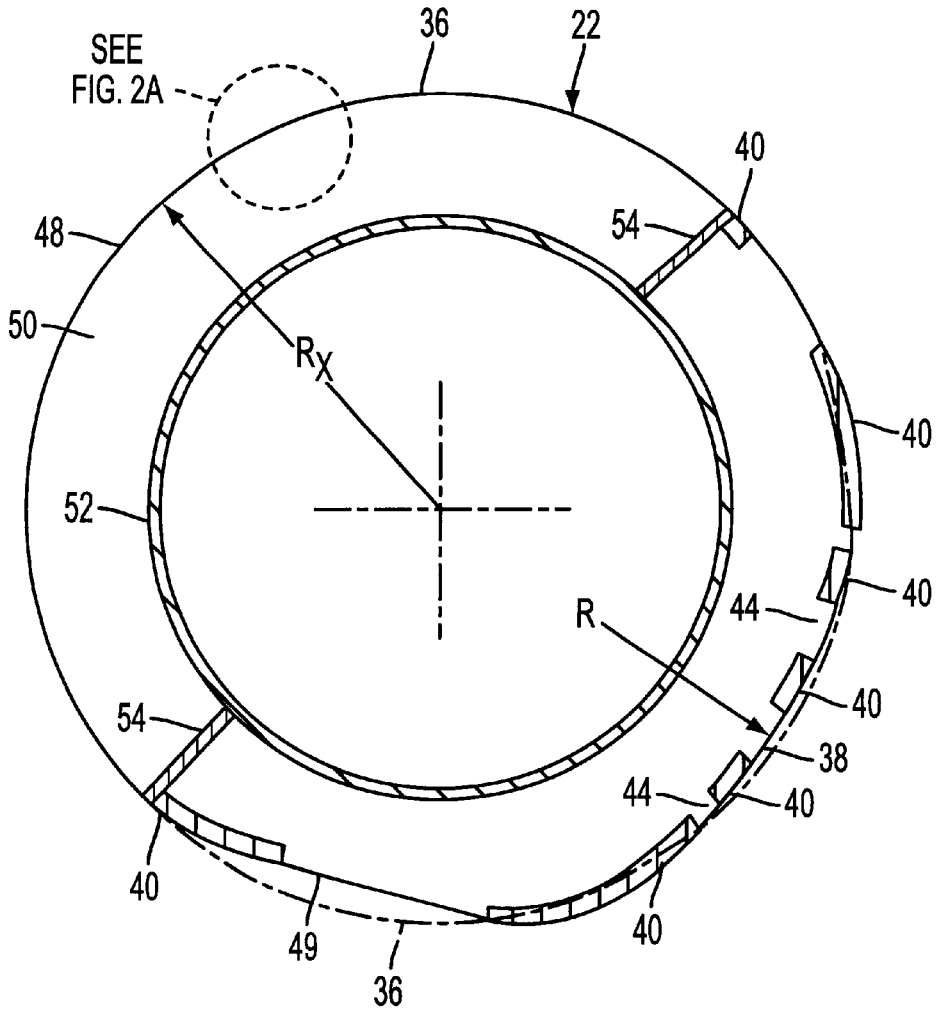
FIG. 2 illustrates an enlarged view of the belt guidance device depicted in FIG. 1.

A revolving flexible support belt 22 (also see FIG. 2) is provided inside the loop of upper wire 16 and upper wire 16 is guided on flexible support belt 22 in a vicinity of inlet nip 20. Consequently, upper wire 16 is supported by revolving flexible support belt 22, particularly in an initial or support region 24 of twin wire zone 14. In support region 24, upper wire belt 16 is arranged so that an inside surface rests against flexible support belt 22. Since wire belts 16 and 18 are guided parallel to one another, lower wire belt 18 is also supported against flexible support belt 22, i.e., by fibrous material web 12 to be formed, which is located between wire belts 16 and 18 and by upper wire belt 16, which is resting directly on support belt 22.

Furthermore, upper wire belt 16 is guided by deflection rolls 26.

In the vicinity of inlet nip 20, lower wire belt 18 is guided around a deflection roll 28 and, at the end of twin wire zone 14, is guided by a wire suction roll 30. In the exemplary embodiment, twin wire zone 14 has a course which is generally directed diagonally upwardly starting from inlet nip 20. In the vicinity of wire suction roll 30, upper wire belt 16 is separated from lower wire belt 18 by being guided upwardly by deflection roll 26, which is arranged opposite wire suction roll 30. After wire suction roll 30, fibrous material web 12 is carried along by lower wire belt 18.

Inlet nip 20 formed between wire belts 16 and 18 is supplied with fibrous suspension 34 by a headbox 32.

Revolving flexible support belt 22 is generally guided in or along an at least essentially circular cylindrical path, i.e., generally at least approximately along a circular cylindrical path 36 (depicted in FIG. 1 with dot-and-dash lines), however, flexible support belt 22 can deviate from essentially circular path in a definite manner in certain regions. Consequently, in support region 24, flexible support belt 22 is guided along a support path 38 which deviates from circular cylindrical path 36 and which has an average curvature radius R that is greater than a radius $R_K$ of circular cylindrical path 36 and, in particular, that is greater than an average curvature radius of an entire path 48 through which support belt 22 travels (see also FIG. 2).

Figure 2A:
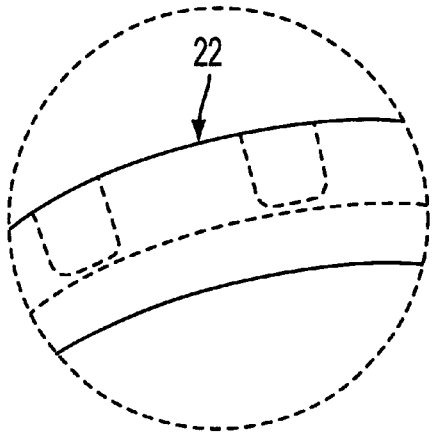
FIG. 2A illustrates a detailed view of the flexible support belt.

In the exemplary embodiment, flexible support belt 22 can include an open outer circumference surface that can be utilized, e.g., to receive and store water. Therefore, the outer circumference surface of flexible support belt 22 can be, e.g., grooved and/or provided with blind bores, as illustrated in FIG. 2A.

In support region 24, flexible support belt 22 is guided by way of internal support elements 40 which are spaced apart from one another in a web travel direction L.

Lower wire belt 18, which is located on a side of twin wire zone 14 remote from support belt 22, can be acted on by internal pressing elements 42, which can be pressed against lower wire belt 18 in a flexible manner and which can be, e.g., former strips or the like.

Pressing elements 42 are located inside the loop of lower wire belt 18 and are positioned opposite intermediary spaces 44 between support elements 40. As a result, wire belts 16 and 18, together with fibrous material web 12 being formed between them, can be pressed against flexible support belt 22 by pressing elements 42.

Pressing elements or former strips 42 are provided in combination with a forming box 46. Lower wire belt 18 can be acted on internally by suction elements, e.g., slot suction elements. These suction elements are positioned opposite support elements 40 and/or opposite intermediary spaces 44 between them.

Furthermore, in the region before inlet nip 20, flexible support belt 22, while generally guided in an at least essentially circular cylindrical manner, is guided along a path 49 that extends inside circular cylindrical path 36. This region or path 49 is defined by two internal support elements 40 which are spaced apart from one another. Thus, flexible support belt 22 travels in a straight line between the two support elements 40. Moreover, the additional space produced by the deviation of path 49 can be utilized in the manner shown in FIG. 1, e.g., by a front, upper region of headbox 32. In this way, headbox 32 can be moved closer to twin wire zone 14 so that a geometrically more favorable arrangement can be produced.

To guide flexible support belt 22 on support elements 40 located within a lower half of the loop flexible support belt 22, an inner region 50 within the loop of flexible support belt 22, which is remote from, and sealed off from, the support element region, can be subjected to an overpressure. Flexible support belt 22 can be guided around an internal tube 52 and an annular space formed between internal tube 52 and support belt 22 can be divided by sealing elements 54 into a region that contains support elements 40 and a region that is subjected to overpressure. The overpressure can be, e.g., approximately 50 to 100 mbar and can be adjusted to, e.g., approximately 60 mbar. Fundamentally, however, other pressure values are also conceivable. As a result of the overpressure, in the region that is subjected to the overpressure, support belt 22 has an at least essentially circular cylindrical course that corresponds to the path 36.

Revolving flexible support belt 22 can be laterally fixed by covering disks or the like.

Internally, flexible support belt 22 can be lubricated with fluid, e.g., water, oil, and/or the like, and support elements 40 can be correspondingly designed for such lubrication. In this connection, a hydrodynamic and/or hydrostatic lubrication can be provided.

At least one additional pressing element 56 can be provided after pressing elements 42, i.e., downstream in web travel direction L.

Fundamentally, guidance of support belt 22 according to the present invention can also be used at points in the paper machine other than in the wire section and can fundamentally also have other uses.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Numbers

10 wire section
12 fibrous material web
14 twin wire zone
16 upper wire belt
18 lower wire belt
20 inlet nip
22 flexible support belt
24 support region
26 deflection roll
28 deflection roll
30 wire suction roll
32 headbox
34 fibrous suspension
36 circular cylindrical path
38 path with the greatest curvature radius
40 support elements
42 pressing elements, former strips
44 intermediary spaces
46 forming box
48 path
49 path
50 inner region
52 internal tube
54 sealing elements
L web travel direction
R large average curvature radius
$R_K$ radius of the circular cylindrical path

What is claimed:

1. A wire section of a machine for producing a fibrous material web comprising:

two revolving endless wire belts;

a twin wire zone formed between said two revolving endless wire belts;

a revolving flexible support belt located in a vicinity of said twin wire zone and positioned to support at least one of said two wire belts in a support region, wherein said flexible support belt is generally guided along an at least essentially circular cylindrical path;

said support region including a support path having an average curvature radius that is greater than a curvature radius of the essentially circular path; and internal support elements, positioned in said support region to guide said revolving flexible support belt, said internal support elements being spaced apart from one another in a web travel direction.

2. The wire section in accordance with claim 1, wherein said average curvature radius of said support path is greater than an average curvature radius of an entire path through which the support belt travels.

3. The wire section in accordance with claim 1, wherein said flexible support belt is located within a loop formed by said at least one wire belt.

4. The wire section in accordance with claim 1, wherein said flexible support belt includes an open outer circumference surface adapted to store water.

5. The wire section in accordance with claim 4, wherein said outer circumference surface of the flexible support belt is one of profiled and blind bored.

6. The wire section in accordance with claim 1, further comprising internal pressing elements positioned opposite intermediary spaces between said support elements, said internal pressing elements being arranged to act on the wire belt located on a side of said twin wire zone remote from said flexible support belt by pressing against the wire belt.

7. The wire section in accordance with claim 6, wherein said internal pressing elements are arranged to act on both of said two wire belts as well as the fibrous material web being formed between them.

8. The wire section in accordance with claim 6, wherein said internal pressing elements are at least partially composed of former strips.

9. The wire section in accordance with claim 6, further comprising a forming box, wherein said internal pressing elements are provided in combination with said forming box.

10. The wire section in accordance with claim 1, further comprising suction elements positioned opposite at least one of said internal support elements and intermediary spaces between said support elements, said suction elements being arranged to internally act on the wire belt located on a side of said twin wire zone remote from said flexible support belt.

11. The wire section in accordance with claim 1, wherein said flexible support belt includes at least one additional region that is guided along an additional path that extends inside the circular cylindrical path.

12. The wire section in accordance with claim 11, wherein said at least one additional region creates an additional space, and wherein said additional space is at least partially occupied by another element of the machine.

13. The wire section in accordance with claim 12, wherein said another element of the machine is a headbox.

14. The wire section in accordance with claim 11, further comprising internal supports located spaced from each other, wherein said additional region is defined by two of said internal support elements, and said additional path includes a straight path between said two internal support elements.

15. The wire section in accordance with claim 1, wherein said flexible support belt includes an inner region which is positioned remote from said support region.

16. The wire section in accordance with claim 15, wherein said inner region is sealed off from said support region, and said inner region is subjected to an overpressure.

17. The wire section in accordance with claim 16, wherein the overpressure is between approximately 50 and 100 mbar.

18. The wire section in accordance with claim 16, wherein the overpressure is adjusted to approximately 60 mbar.

19. The wire section in accordance with claim 1, further comprising an internal tube, wherein an annular space is formed between said internal tube and said support belt;

sealing elements positioned to divide said annular space into said support region and a region subjected to overpressure.

20. The wire section in accordance with claim 19, wherein said support region includes a plurality of support elements.

21. The wire section in accordance with claim 19, wherein the overpressure is between approximately 50 and 100 mbar.

22. The wire section in accordance with claim 19, wherein the overpressure is adjusted to approximately 60 mbar.

23. The wire section in accordance with claim 1, further comprising covering disks, wherein said revolving flexible support belt is laterally fixed by said covering disks.

24. The wire section in accordance with claim 1, wherein said flexible support belt is internally lubricated.

25. The wire section in accordance with claim 24, wherein said flexible support belt is internally lubricated with a fluid.

26. The wire section in accordance with claim 24, wherein said flexible support belt is at least one of hydrodynamically and hydrostatically lubricated.

27. The wire section in accordance with claim 26, further comprising support elements located within said flexible support belt in said support region, and said support elements being lubricated in a manner corresponding to the internal lubrication of said flexible support belt.

28. The wire section in accordance with claim 1, wherein the fibrous material web comprises one of a paper and a cardboard web.

29. A belt guidance device for an apparatus for producing a fibrous material web, comprising:

a flexible support belt in the form of a loop;

a plurality of support elements located inside the loop of said flexible support belt, said plurality of support elements being arranged to generally guide said flexible support belt along an at least essentially circular cylindrical path;

said flexible support belt including a support region adapted to support and guide at least one of a wire belt and felt band along a support path that deviates from the circular cylindrical path and that has an average curvature radius that is greater than a radius of the circular cylindrical path; and internal support elements, positioned in said support region to guide said flexible support belt, said internal support elements being spaced apart from one another in a web travel direction.

30. The belt guidance device in accordance with claim 29, wherein said support path has an average curvature radius that is greater than an average curvature radius of an entire path through which said flexible support belt travels.

31. The belt guidance device in accordance with claim 29, wherein said flexible support belt includes has an open outer circumference adapted to store water.

32. The belt guidance device in accordance with claim 29, wherein said outer circumference surface of said flexible support belt is at least one of profiled and blind bored.

33. The belt guidance device in accordance with claim 29, wherein said flexible support belt includes at least one additional region that is guided along an additional path that extends inside the circular cylindrical path.

34. The belt guidance device in accordance with claim 33, further comprising internal supports located spaced from each other, wherein said additional region is defined by two of said internal support elements, and said additional path includes a straight path between said two internal support elements.

35. The belt guidance device in accordance with claim 29, wherein said flexible support belt includes an inner region which is positioned remote from said support region.

36. The belt guidance device in accordance with claim 35, wherein said inner region is sealed off from said support region, and said inner region is subjected to an overpressure.

37. The belt guidance device in accordance with claim 36, wherein the overpressure is between approximately 50 and 100 mbar.

38. The belt guidance device in accordance with claim 36, wherein the overpressure is adjusted to approximately 60 mbar.

39. The belt guidance device in accordance with claim 29, further comprising an internal tube, wherein an annular space is formed between said internal tube and said support belt;

sealing elements positioned to divide said annular space into said support region and a region subjected to overpressure.

40. The belt guidance device in accordance with claim 39, wherein said support region includes a plurality of support elements.

41. The belt guidance device in accordance with claim 39, wherein the overpressure is between approximately 50 and 100 mbar.

42. The belt guidance device in accordance with claim 39, wherein the overpressure is adjusted to approximately 60 mbar.

43. The belt guidance device in accordance with claim 29, further comprising covering disks, wherein said revolving flexible support belt is laterally fixed by said covering disks.

44. The belt guidance device in accordance with claim 29, wherein said flexible support belt is internally lubricated.

45. The belt guidance device in accordance with claim 44, wherein said flexible support belt is internally lubricated with a fluid.

46. The belt guidance device in accordance with claim 44, wherein said flexible support belt is at least one of hydrodynamically and hydrostatically lubricated.

47. The belt guidance device in accordance with claim 46, further comprising support elements located within said flexible support belt in said support region, and said support elements being lubricated in a manner corresponding to the internal lubrication of said flexible support belt.

48. A process of forming a fibrous material web in an apparatus that includes a twin wire zone formed between two endless wire belts, a revolving flexible support belt located in a vicinity of the twin wire zone, said process comprising:

supporting at least one of the two endless wire belts with the flexible support belt in a support region;

rotating the flexible support belt along a generally circular path;

deflecting the support belt from the generally circular path in the support region, whereby the support belt in the support region travels along a support path delineated by internal support elements in the support region which are spaced apart from one another in a web travel direction, wherein an average radius of curvature of the flexible support belt in the support path is greater than an average radius of curvature of the flexible support belt in the generally circular path.

49. The process in accordance with claim 48, wherein the average radius of curvature of the flexible support belt in the support path is greater than an average radius of curvature for an entire travel path of the flexible support belt.

50. The process in accordance with claim 48, further comprising inserting fibrous material between the two wire belts; and pressing the two wire belts and the fibrous material therebetween against the flexible support belt.

51. The process in accordance with claim 50, further comprising suctioning the fibrous material through the wire belt positioned remote from the flexible support belt.

52. The process in accordance with claim 48, further comprising deflecting another portion of the flexible support belt along a path that extends through the generally circular path.

* * * * *